US009303409B2

(12) United States Patent
Lopez et al.

(10) Patent No.: US 9,303,409 B2
(45) Date of Patent: Apr. 5, 2016

(54) CLEANOUT BOOM

(71) Applicants: Luis F. Lopez, Miami, FL (US); Emmanuel Pacin, Miami, FL (US)

(72) Inventors: Luis F. Lopez, Miami, FL (US); Emmanuel Pacin, Miami, FL (US)

( * ) Notice: Subject to any disclaimer, the term of this patent is extended or adjusted under 35 U.S.C. 154(b) by 164 days.

(21) Appl. No.: 14/225,362

(22) Filed: Mar. 25, 2014

(65) Prior Publication Data

US 2015/0276106 A1 Oct. 1, 2015

(51) Int. Cl.

| | |
|---|---|
| ***F16L 27/12*** | (2006.01) |
| ***E04D 15/00*** | (2006.01) |
| ***E04D 13/076*** | (2006.01) |

(52) U.S. Cl.

CPC ..... *E04D 15/00* (2013.01); *E04D 13/0765* (2013.01); *E04D 15/006* (2013.01)

(58) Field of Classification Search

CPC ..... F16L 37/002; F16L 27/12; E04D 15/006; E04D 13/0765

USPC ..... 285/920, 302

See application file for complete search history.

(56) References Cited

U.S. PATENT DOCUMENTS

| | | | | |
|---|---|---|---|---|
| 3,712,331 | A * | 1/1973 | Otto | E03F 1/008 137/355.16 |
| 4,102,523 | A * | 7/1978 | Finnell | F16L 3/26 137/106 |
| 4,168,559 | A * | 9/1979 | Henson | E04D 13/0765 15/23 |
| 5,023,959 | A * | 6/1991 | Mercer | F16L 3/003 137/355.16 |
| 5,947,156 | A * | 9/1999 | Tomczyk | E03F 1/008 137/355.16 |
| 6,123,367 | A * | 9/2000 | Miller | E03F 1/008 137/899 |

* cited by examiner

*Primary Examiner* — David E Bochna

(74) *Attorney, Agent, or Firm* — Christopher J. Vandam, PA; Chris Vandam

(57) ABSTRACT

A cleanout boom for guiding a plumbing snake, pressure washer, camera or a similar apparatus into a vent pipe on the roof of a structure. A head assembly with a remote mechanism to attach the head assembly to the vent. The device can be entirely operated from the ground.

7 Claims, 4 Drawing Sheets

CLEANOUT BOOM

BACKGROUND OF THE INVENTION

1. Field of the Invention

The present invention relates to plumbing, and more particularly, to cleaning and inspecting roof vents and other plumbing pipes.

2. Description of the Related Art

Modern plumbing systems in residential and commercial structures are generally entirely gravity driven on the drain side of the equation. For water to quickly drain out of the bottom of the system, for example into a sewer or septic system, a vent must allow air into the pipes above the drain.

Vents are commonly vertical pipes that traverse a structure from the pipes in the walls or under the floors up through the roof.

Vent pipes, sometimes referred to as vent stacks, conveniently provide a point of access into the plumbing system for inspection, repair and, most commonly, clean out.

It is common practice for plumbers to insert long wire snakes into roof vents that travel down the vent then into the drain pipes inside or under the structure. The snakes can break up an obstruction so it can be flushed out or can attach to a clog to pull it back up the stack.

More recently, as an alternative to metal snakes, a high pressure water jet hose can be fed down the stack to free a clog in a pipe.

In some cases video inspection cameras can be fed down a vent pipe on a long signal cable to get an improved diagnosis of the conditions and problems inside of a pipe.

Several designs for roof vent pipe cleaning and inspection tools have been designed in the past. None of them, however, includes a device that can be operated from the ground to attach onto a roof vent stack and effectively clean out and inspect the pipe without a person ever getting onto the roof of the structure.

Applicant believes that the closest reference corresponds to commonly used wire cleanout snakes, brushes, high pressure water washers and the like. A plumber must climb the roof to access the roof vent (or other plumbing structure to be examined or cleared). Heavy equipment, such as a snake reel with motor, must be up and carried onto the roof with them.

This creates a potentially dangerous situation involving personnel climbing a latter. The equipment that the plumber will use must be carried up the ladder or hoisted from the roof. Either situation carries with it risk for both the plumber on the roof and other people on the ground below.

A wire snake assembly with motor can weigh eighty pounds or more. In some cases with extended runs of snake the entire apparatus could weigh well over a hundred pounds. This is a significant amount for one man to carry up a ladder onto the roof.

Further, damage can result from a plumber on the roof damaging the roof itself or injuring himself by stepping through soft or damaged roofing structure when carrying heavy equipment.

Many injuries happen annually in the United States to plumbers and other tradesman falling off from roofs. It would greatly increase safety and decrease risk of injury to man and machine by avoiding placing either on a roof.

Other solutions have included boom and bucket trucks. In this solution a bucket truck must physically be positioned at the base of the structure and within reach of the area on the roof which requires attention. The boom has a limited range of reach. The truck can damage sensitive landscaping or other elements. The boom trucks are expensive and also require a skilled operator to work safely.

Yet others may use scaffolding or climbing harnesses. Each is expensive and potentially dangerous. Special training and skill is usually required to use either of these methods safely.

Other patents describing the closest subject matter and commonly used techniques provide for a number of more or less complicated features and methods that fail to solve the problem in an efficient and economical way. None of these patents suggest the novel features of the present invention.

SUMMARY OF THE INVENTION

It is one of the main objects of the present invention to provide a plumbing cleanout that can be operated completely from the ground.

It is another object of this invention to provide a device to increase safety of the workers. Increased safety can mean reduced cost of insurance and risk of legal liability.

It is still another object of the present invention to provide a device that can aid in cleaning out or inspecting pipes in a fraction of the time that it would take to get workers and equipment onto the roof of a structure.

It is yet another object of this invention to provide such a device that is inexpensive to manufacture and maintain while retaining its effectiveness.

Another object of at least a version of the device is to be operable by a single worker.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
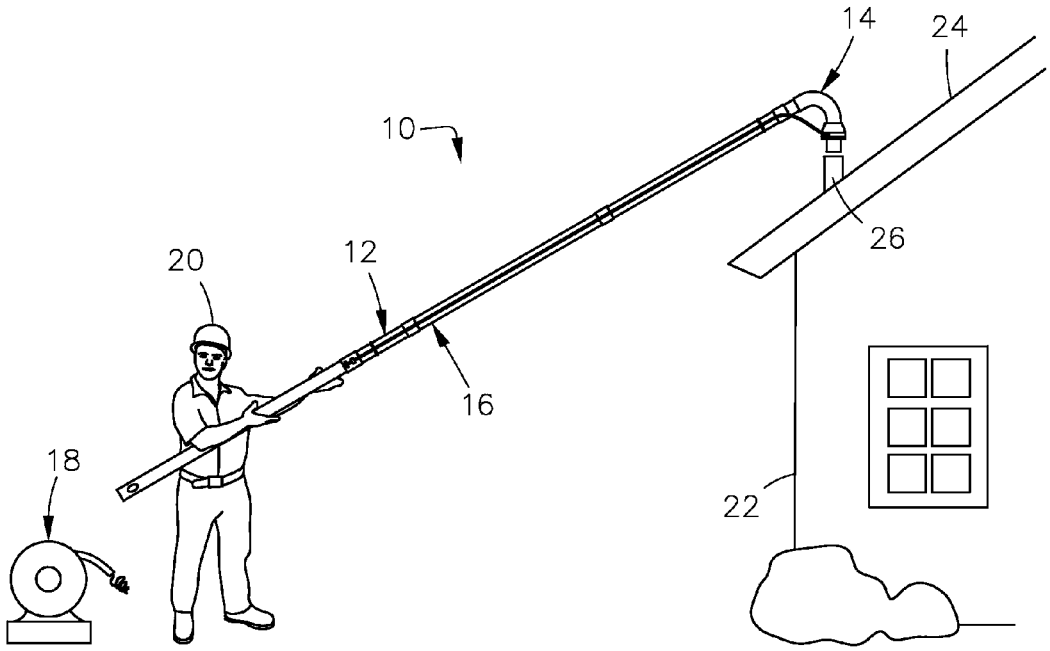
FIG. 1 represents a perspective view of a worker on the ground using a cleanout boom.

Referring now to the drawings, where the present invention is generally referred to with numeral 10, it can be observed in FIG. 1 that it basically includes a pole assembly 12, a head assembly 14, a clamp assembly 16 and a reamer assembly 18. An operator 20, a house 22 and a vent 26 are shown for context and are not considered elements of the device.

It can be seen in FIG. 1 that the device is generally used by an operator 20 on the ground near a house 22 or other structure. The pole assembly 12 is controlled by the operator 20 on the lower end. On the upper end of the pole assembly 12 is affixed a head assembly 14.

The head assembly 14 is positioned over a vent 26 pipe on the roof 24 of the house 22 by the operator 20 manipulating the pole assembly 12. Once the head assembly 14 is set onto the vent 26, the operator can activate the clamp assembly 16 from the ground to gain a positive connection between the head assembly 14 and the vent 26. The operator 20 ideally never leaves the security of the ground.

Now that the head assembly 14 is firmly attached to the vent 26 then the operator 20 can set the lower end of the pole assembly 12 down (or onto a stand or legs as described below). The operator 20 then addresses the reamer assembly 18 by feeding the reamer along the length of the pole assembly 12 then through the head assembly 14 and into the vent 26 and beyond in the plumbing system of the structure.

It should be appreciated that although this example and some of the other examples contained herein refer to a reamer, there are a number of devices that can be used with the cleanout boom. For example, a snake, an auger, a pressure washer, a camera, or a location identifier can be used effectively.

Another application may include pipe repair apparatus such as remote manipulators, grout or sealant balloons and pumps or other available methods and apparatus for inspecting and repairing pipes when accessed from a roof vent.

Figure 2:
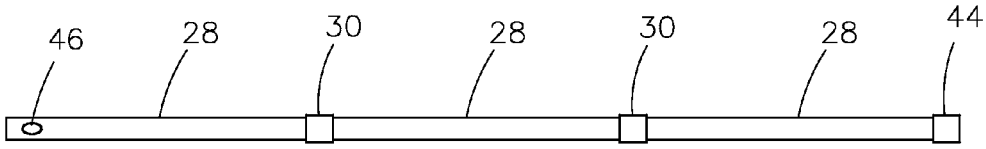
FIG. 2 shows an elevation view of a segmented version of a pole assembly.

Referring now to FIG. 2 where a version of a pole assembly is shown to include, among other things, several segments 28, several unions 30, a union 44 and an aperture 46.

In this version of the pole assembly uses multiple segments 28 that are connected end to end with a union 30. The union 30 could be manifest in a distinct fitting or could be integral with the ends of the individual segments. Segments 28 might be made available in a variety of lengths to mix and match together to achieve a desired overall length of the pole assembly.

Each of the segments 28 may be similar in diameter and thread configuration so that any segment 28 can be used in any order and the ends of each segment 28 are similar so that there is no discernable top or bottom end of each segment 30.

In a variant of a pole assembly similar to that shown in FIG. 2 the segments 28 are lengths of pipe with external threads on each end. The unions 30 could then be a short (several inches) pipe with internal threads open at both ends. In this variant the unions 30 are similar to a common pipe union fitting.

The union 44 is adapted to be attached to a head assembly. The union 44 may be similar to the unions 30. The union 44 may also be a particular fitting suited to attachment of a head assembly. For example, union 44 may be a hole and spring button type of attachment similar to that used on many tent poles, crutches and pool pole devices so that a head assembly can toollessly be installed and removed. Other clip mechanisms could also be effectively uses for attaching a pole assembly to a head assembly.

On the lower end of a pole assembly, opposite the end attached to a head assembly, is optionally an aperture 46. The aperture 46, if present, allows an access port to the interior of the pole assembly within which to insert a reamer assembly.

Alternatively to the aperture 46, the reamer assembly can be inserted into the lower end of the pole assembly. However, there are advantages to having an aperture 46 when the pole assembly is used with the lower end on the ground or otherwise encumbered by a stand. This can allow easier pass through of a reamer assembly into the pole assembly.

Another alternative to an aperture is a series of eyelet guides along the length of the pole assembly. In a sense, this is similar in function to the eyelets on a common recreational fishing pole, to guide the reamer assembly along the length of the pole assembly and towards the head assembly where it enters into the roof vent.

Figure 3:
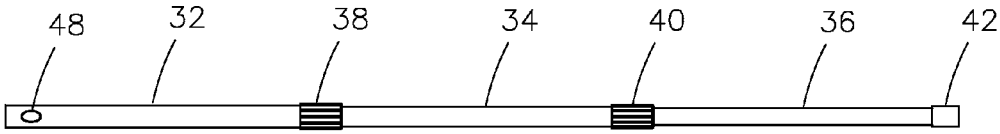
FIG. 3 illustrates an elevation view of a telescoping version of a pole assembly.

Referring now to FIG. 3 where yet another effective version of a pole assembly is shown that includes, among other features, a segment 32, a segment 34, a segment 36, a clamp 38, a clamp 40, a union 42 and an aperture 48.

This variety of pole assembly differs at least in that the pole assembly is comprised of several telescoping segments 32, 34 and 36. Generally, the lower segment 32 would be larger than the next segment 34 which is in turn larger than the top segment 36. When collapsed, segment 34 nests inside of segment 32 and segment 36 nests inside of segment 34.

Although FIG. 3 shows three telescoping segments, there could be more or fewer segments depending on the design and application of the pole assembly. In most cases there will be between two and ten segments in each pole assembly.

When the desired length of extension or retraction is achieved by the operator the length of the pole assembly may be locked with a clamp, such as the clamp 38 between segment 32 and 34. Likewise, the clamp 40 is similarly used between segment 34 and segment 36. The clamps 38 and 40 can be any of a variety of clamping mechanisms such as a ferrule and compression fitting found on devices such as a telescopically extending pool skimmer net pole assembly. A twist of the clamp in one direction tightens the adjacent segments. A twist of the clamp in the other direction loosens the connection for telescoping the segments apart or together.

Optionally in any of the pole assemblies there is an aperture 48 in which the long snake cable or other reamer assembly can be continuously fed along the length of the pole assembly to extend its reach well into the vent and beyond into the plumbing structure of the building. Typically the aperture 48 in any version of the cleanout boom is near to the lower end of the pole assembly. The distance between the lower end and the aperture is generally from an inch or two from the end to about six feet from the lower end. The aperture should be positioned conveniently for an operator to access it and feed a reamer through it from a ground position.

In yet another version of the pole assembly there may be only a single segment of pole. This may be a simple and robust design suitable for lower roof lines and for access to vents that do not require the reach of other extendible poles.

Figure 4:
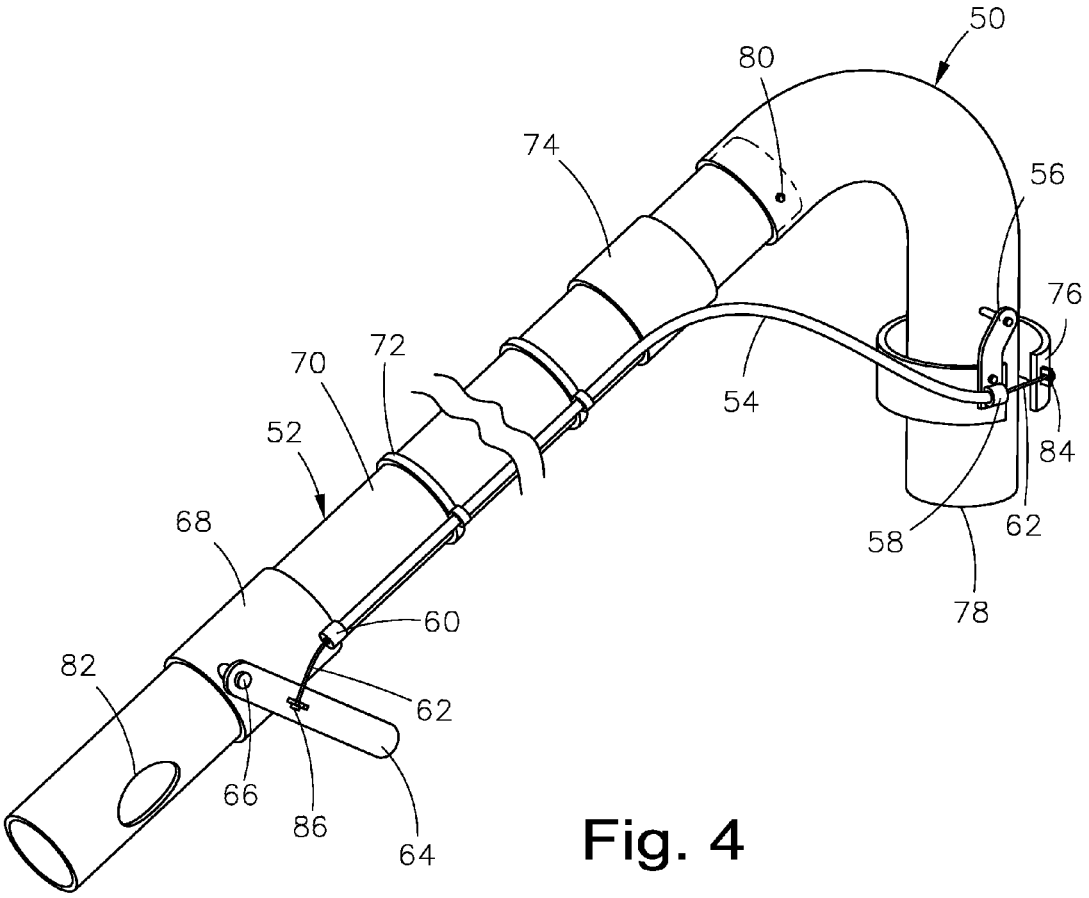
FIG. 4 is a perspective representation of a head assembly.

Looking at FIG. 4 a version of cleanout boom that is shown to be comprised of an embodiment of a head assembly 50 and a version of a pole assembly 52 combination is exhibited and may include, among other elements, a sheathed cable 54, a bracket 56, a cable stop 58, a cable stop 60, a cable 62, a handle 64, a pivot 66, a bracket 68, a segment 70, a strap 72, a union 74, a clamp 76, a tip 78, a hinge 80, an aperture 84, a stop 86 and a stop 88.

Notice that FIG. 4 includes a break in the middle that is included to indicate that the proportions or length of the device is not necessarily to scale. Intermediate segments of pole assembly could be present in the break.

In the FIG. 4 version a more detailed view of a head assembly illustration is seen to include a flexible clamp 76. Generally, in use the tip 78 of the head assembly 50 is inserted into a vent pipe on a roof. The tip 78 is allowed to be inserted to the point where the clamp 76 can be constricted around the exterior top of the vent pipe.

When the head assembly 50 is temporarily secured to the vent pipe then the snake or other reamer assembly can be threaded along the pipe assembly 52 from the ground by the operator and is guided through the head assembly 50 and directed down into the vent and then into the pipes below the vent for repair, obstruction removal, inspections or any of the other beneficial uses shown herein.

The constriction mechanism of the clamp 76 is controlled from the ground by operation of the handle 64 in conjunction with the sheathed cable 54 and other elements. The sheathed cable 54 includes a cable 62 that slides axially inside a sheath. The sheath remains relatively fixed during operation of the mechanism and is held in place on the head assembly 50 at the cable stop 58 affixed to the bracket 56. On the lower end of the pole assembly 52 the sheath is held in place by the cable stop 60.

When the handle 64 is actuated about pivot 66 it acts a lever to pull the cable 62 out of the sheath or to push the cable back into the sheath. The handle 64 connects to the handle at stop 86.

In the embodiment of the device shown in FIG. 4, when the handle 64 is pulled back towards the lower end of the pole assembly the cable 62 is drawn out of the sheath at the stop 60. This pulling action is translated by the cable 62 to the stop 84 so that the stop 84 is pulled toward the cable stop 58 and the clamp 76 is thus constricted to grab onto the vent.

The cleanout boom may be provided with clamps 76 of several diameters to accommodate various diameters of vent pipe. It is important for efficient use that the head assembly 50 be securely attachable to the vent. A clamp 76 may be dimensioned to work with a range of vent pipe diameters.

The bracket 68 connects the handle 64 assembly and cable stop 60 to the pole assembly 52. The bracket 68 allows for flexibility in locating the handle on a segment 70 of pole assembly 52.

Similarly, bracket 56 secures the upper end of the sheathed cable 54 and the cable stop 58 from the head assembly 50 to the clamp 76. The bracket 76 holds the clamp 76 in relative position to the tip 78 so that the tip 78 and clamp 76 are appropriately juxtapositioned for insertion into a vent and clamping the head assembly 50 to the outside surface of the vent.

Union 74 is optionally present to connect the head assembly 50 to the pole assembly 52 and yet allow disassembly when necessary for breakdown, storage and transport of the cleanout boom.

Similar to other versions of the device, an aperture is provided to allow the reamer assembly to be inserted and fed into and through the pole assembly 52 and then onto and out through the tip 78 of the head assembly 50 where it can do its work.

Another optional feature demonstrated in FIG. 4 is the hinge 80 that is near the connection between the pole assembly 52 and the head assembly 50. The hinge 80 may be a loose rivet or bolt on either side of the head assembly and through a section of pipe.

The hinge 80 allows a range of articulation between the head assembly 50 and the axis of the pole assembly 52. This is useful to allow easier entry of the tip 78 into the vent. In many anticipated uses it may be easier to have the tip 78 portion of the head assembly as close to vertical as possible because the vent pipe to which it will mate are generally plumb.

For example, a shorter distance between the operator and a roof vent may require a smaller angle between the head assembly 50 and pole assembly 52 to better engage the tip 78 into the vent. Conversely, for a longer distance between the operator combined with a lower vent it may be preferred to have an angle between the pole assembly 52 and head assembly 50 nearer to a right angle.

In some versions of the device the hinge 80 is relatively tight due to friction in the joint so that the angle between the pole assembly 52 and head assembly 50 is estimated and set on the ground level before the head assembly 50 is raised over the roof vent.

In yet other versions the hinge 80 is relatively loose and the vertical orientation of the tip 78 on the head assembly 50 is maintained by gravity for easier insertion of the tip 78 into the vent.

In another method of use the tip 78 is set into the top opening of the vent and the pole assembly is pushed or pulled to articulate the head assembly 50 to achieve vertical orientation of the tip 78 for improved insertion into the vent.

Straps 72 are optionally provided to hold the sheathed cable 54 in position along the length of the pole assembly 52. This helps prevent the sheathed cable 54 from tangling with or interfering with other elements of the job site or device. The straps 72 could be formed of clips, straps, bands or the like that allow capture and removal of the sheathed cable 54 from the side of the pole assembly.

The sheathed cable 54 can also be routed inside the interior of the pole assembly 52 and then exit the pole assembly 52 before reaching the head assembly 50.

Figure 5:
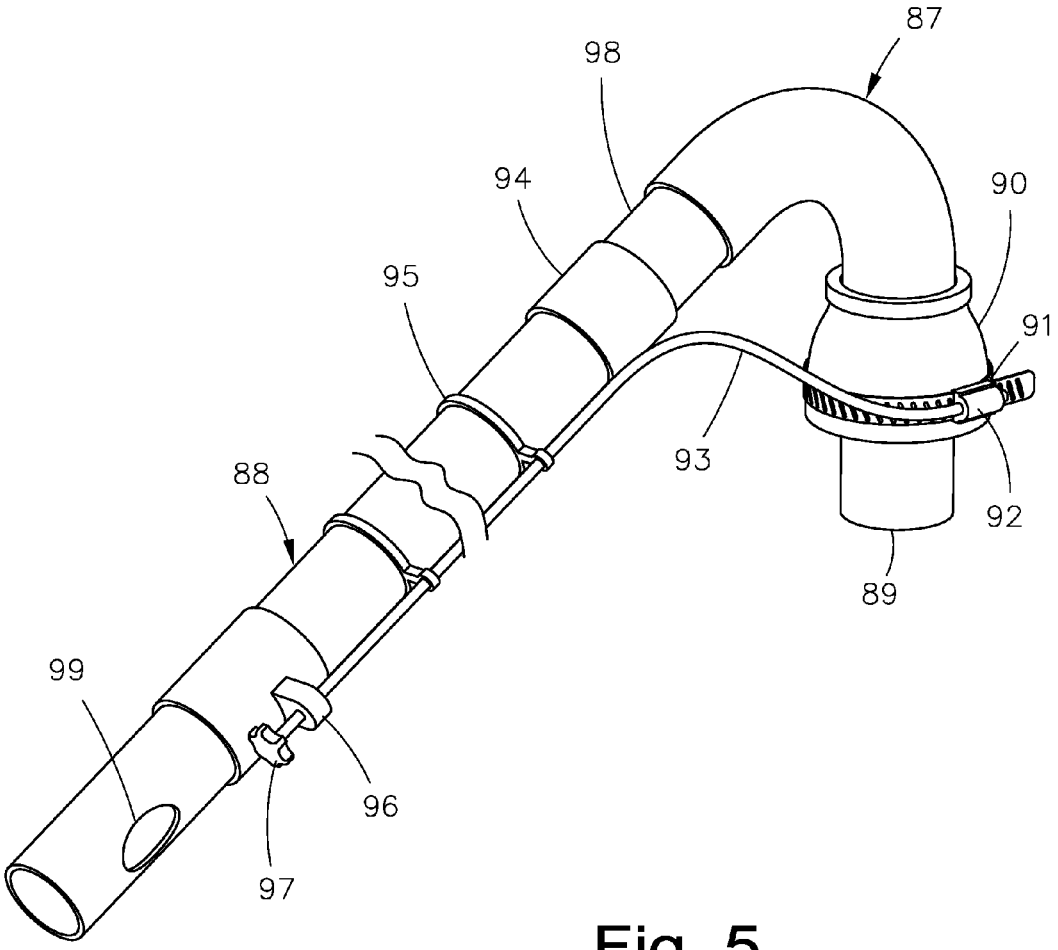
FIG. 5 is a perspective view of a version of a head assembly.

FIG. 5 exhibits a variant of a cleanout boom that has an alternative head assembly 87 and optional pole assembly 88 that is shown to include, by way of example, a tip 89, a boot 90, a clamp 91, a cinch 92, a flex shaft 93, a union 94, a strap 95, a bracket 96, a segment 97 and an aperture.

FIG. 5 also includes a break near the middle of the figure similar to that shown in FIG. 4 to indicate that a portion of the pole assembly 88 has been excised for compact presentation.

This figure should not, nor any of the other several drawings provided herein, be used to indicate dimensions or to extrapolate precise relationships and proportionality. Instead, some of the drawings are somewhat stylized to emphasize an enabling embodiment and for clarity.

This combination in FIG. 5 demonstrates several other optional features that may be used in combination or mixed and matched with other features, variations and embodiments. Particularly FIG. 5 is shown to emphasize an alternated head assembly 87 and clamp 91 mechanism as well as a flexible segment 98.

The pole assembly 88 is connected to the head assembly 87 with a union 94. The union 94 allows easy attachment and separation of the head assembly 87 from the pole assembly 88.

The boot 90 in combination with clamp 91 and other elements is used to attach the head assembly 87 to a roof vent. The flex shaft 93 allows the operator to tighten the clamp 91 from the low end of the pole assembly 88 while standing on the ground.

During a typical use the pole assembly 88 is configured at the required length and the head assembly 87 is attached to the pole assembly. The tip 89 of the head assembly 87 is lowered into the upper opening of the vent pipe. As the tip 89 is inserted the boot 90 covers the outside of the top of the pipe. The clamp 91 can then be constricted to securely connect the head assembly 87 to the vent.

The clamp 91 around the periphery of the lower edge of the boot 90 has a cinch 92. The cinch 92 may take the form of a worm gear that engages into matching cutouts in the clamp 91. Similar clamps are available as hose clamps, band clamps, radiator clamp and other similar types of products. Generally, when the worm gear is rotated with a wrench or screwdriver the circumference of the clamp is reduced or enlarged.

The cinch 92 is connected to a flex shaft 93 at an upper end and at a lower end the flex shaft 93 is connected to a handle 97. The handle is allowed to rotate axially in the bracket 96 that is attached to the lower end of the pole assembly 88 where it can be manipulated by the operator while remaining standing on the ground.

The flex shaft 93 allows the torque applied to the handle 97 to be efficiently transferred to the cinch 92 so that the cinch 92 can be rotated to tighten or loosen the clamp 91. The flex shaft 93 can be held adjacent to the pole assembly 88 by means of a strap 95. The strap 95 should not impede the axial rotation of the flex shaft so that the torque applied to the handle 97 is easily communicated to the cinch 91.

The flex shaft 93 transfers rotation in the handle 97 to rotation at the cinch 92. For one rotation of the handle 97 the flex shaft 93 and cinch 92 each rotate one revolution. The flex shaft 93 allows the torque to make the turn between the head assembly 87 and pole assembly 88. The flex shaft 93 works well when the head assembly 87 is articulated at various angles relative to the pole assembly 88.

There may be various sizes of boots 90. Since the diameter of vent pipes can vary so should the possibilities of sizes of the boot 90 and clamp 91 combination. The tip 89 should be securable to the vent pipe so that when the snake or camera is inserted into the vent that the head assembly 87 does not separate from the vent during normal operation.

The segment 98 is optionally present and provides a predetermined degree of flex between the pole assembly 88 and the head assembly 87. The result of the segment 98 is similar to the hinge 80 described as shown in FIG. 4. The flexible nature of the segment 98 can aid the operator in getting the tip 89 vertical for insertion into the vent.

The segment 98 can be semi-rigid segmented pipe that conforms to various angles while on the ground or in use. The segment 98 could also be made of a rubber-like material that gives some degree of flexibility between the head assembly 87 and pole assembly 88 to better position the tip 89 for insertion into the vent.

Aperture 99 is optionally present and is used to allow access to the interior of the pole assembly 88 to run the snake, auger or other reamer assembly towards and through the head assembly 87.

A version of the head assembly can also be actuated by a hydraulically actuated clamp positioned above the tip of the head assembly and operated by a small hydraulic pump near the lower end of the pole assembly where it can be easily actuated by an operator on the ground.

Another version includes a battery powered clamp on the head assembly that is controlled by a wireless remote control. This can obviate the need for mechanical controls that span the length of the pole assembly.

Figure 6:
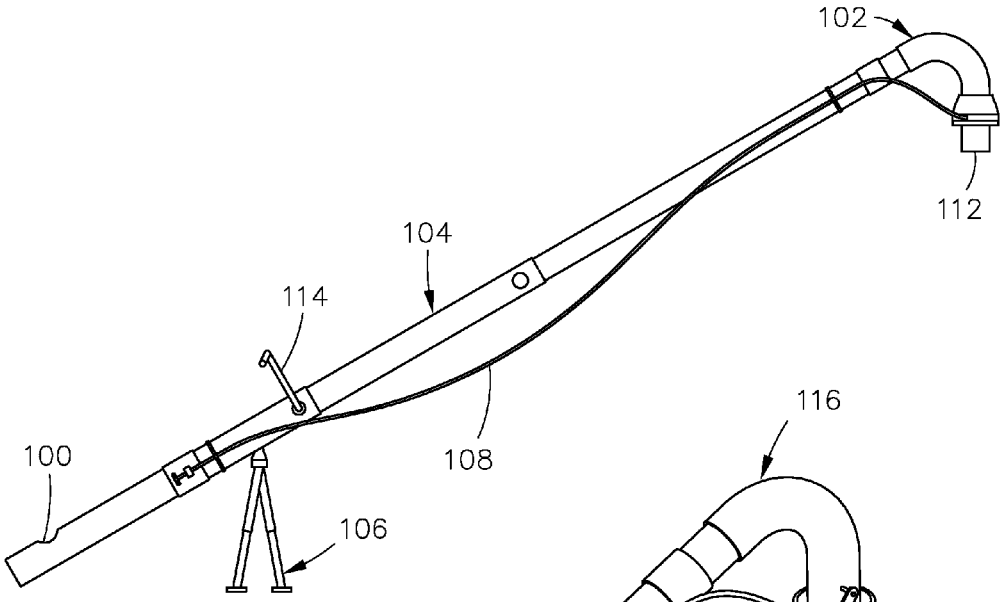
FIG. 6 shows a perspective view of a version of a cleanout boom.

Now referring to FIG. 6, a specimen of a cleanout boom is visible that includes, inter alia, a head assembly 102, a pole assembly 104, a leg assembly 106, a flex shaft 108, an aperture 110, a tip 112 and a crank 114. The flex shaft 108 is similar in form and function to the version shown in FIG. 5 and described in more detail above.

This drawing in FIG. 6 is provided to show optional features that may, in some varietals of the cleanout boom, be present. This version may include telescoping segments of the pole assembly 104 that can be mechanically extended and retracted with crank 114. This may be suitable for heavier duty or longer reach cleanout booms. A gear mechanism associated with the crank 114 moves the telescoping pole assembly 104 in and out.

Optional leg assemblies 106 are shown to support heavier or longer cleanout booms. The leg assemblies 106 may be adjustable in length so that the angle of the pole assembly 104 relative to the ground can be adjusted and then fixed in place. The leg assemblies 106 may optionally fold against the lowermost segment of the pole assembly 104.

Figure 7:
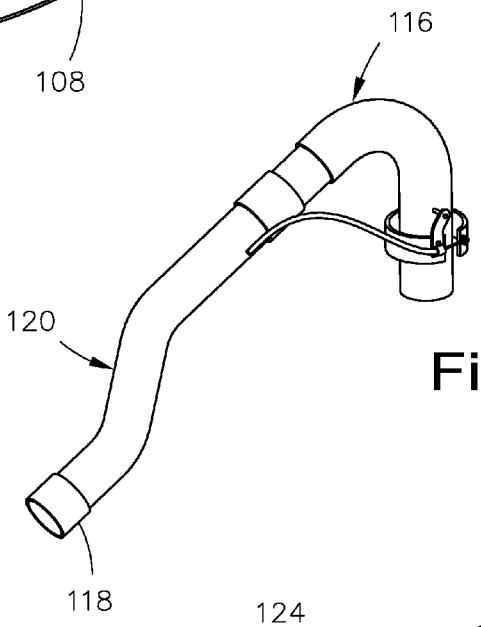
FIG. 7 is a perspective view of an offset segment and a head assembly.

FIG. 7 is a demonstration of accessories that may be used to enhance the performance of the cleanout boom in certain situations and for some uses. These are explained as a head unit 116, a union 118 and an offset assembly 120.

Particularly the offset assembly 120 is pointed to in this example. It generally includes a plurality of bends in a section of pole assembly that can be useful when attempting to mate a head assembly 116 to a difficult to reach roof vent. Often there are multiple roof protrusions or other obstacles to get around when setting up the cleanout boom.

An offset assembly 120 can connect to the upper end of a pole assembly at the union 118 on one end and on the other end of the offset assembly 120 to the head assembly 116. The offset assembly 120 can be used with any version of the head assemblies or pole assemblies described herein.

Figure 8:
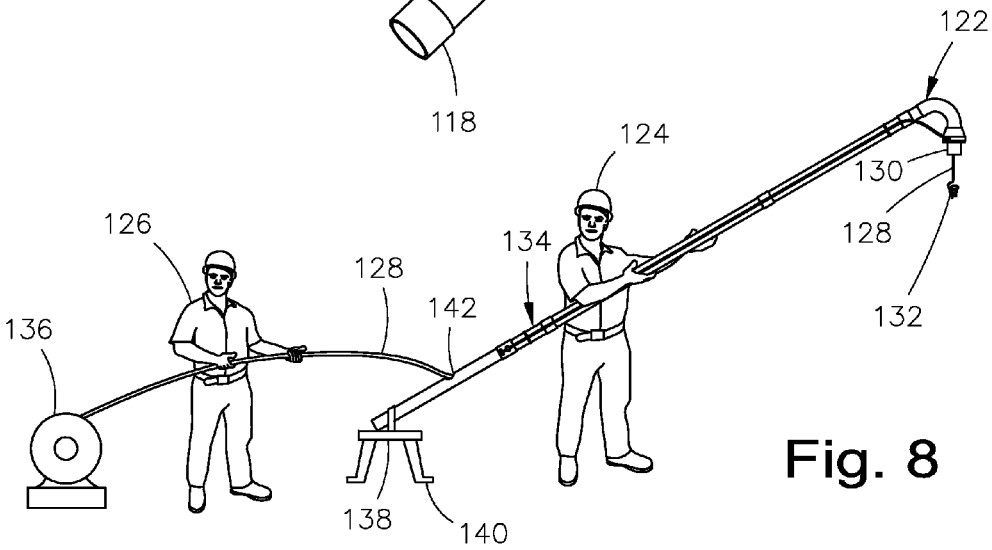
FIG. 8 is a perspective view of a cleanout boom as it might be in use.

Reviewing FIG. 8 in more detail some optional variants and some elements seen in other versions of the cleanout boom are shown to generally include, along with other features that may or may not be clearly seen in this drawing, a head assembly 122, a reamer 128, a tip 130, a tip 132, a pole assembly 134, a reamer assembly 136, a base 138, several feet 140 and an aperture 142. Also shown but not as part of the claimed cleanout boom invention are an operator 124 and another operator 126 working together.

FIG. 8 is a reasonable example of how two people, in this case operator 124 and operator 126, can work in concert to effectively employ a version of a cleanout boom. In this case the operator 124 steadies and positions the pole assembly 134 so that the head assembly 122 is over the subject vent pipe. The tip 130 is placed over the top of the vent pipe and the head assembly 122 secured to the exterior side of the vent pipe.

Once the head assembly 122 is attached, then the operator 126 can begin to feed the reamer 128 from the reamer assembly 136 into the aperture 142. The reamer 128 is forced up through the pole assembly 134 and through the head assembly 122 where the reamer 128 exits the tip 130 and then the tip 132 is forced into the vent pipe and to the plumbing pipes below.

When the operators' work is done then the reamer 128 can be retracted onto the reamer assembly 136 and the cleanout boom can be disassembled for storage or transport.

Similar to some of the other examples, this cleanout boom has a pole assembly 134 that makes up the majority of the length of the boom. The base 138 is provided at the back end of the pole assembly 134 to provide mass and structure to anchor the end of the pole assembly 134 to the ground. Feet 140 are provided to prevent a rotation of the pole assembly 134 when torque is applied to the reamer 128.

A version of the cleanout boom can be fairly described as having, inter alia, a pole assembly and a head assembly. The pole assembly has a first end at the bottom and a second end at the top. The head assembly has a clamp between a first end and a tip. The clamp clamps to the roof vent to secure the head to the roof vent when running a snake or other device into the vent. The second end of the pole assembly is affixed to the first end of the head assembly so that they are connected. The tip is dimensioned to engage into a predetermined vent pipe on a roof. When the tip is engaged into the vent pipe to a predetermined dimension, somewhere on the order of about one to twenty inches with about six inches effective for many applications, then the clamp is positioned around an exterior top of the vent pipe to grab around the pipe. The clamp can be operatively tightened to affix the tip inside the vent pipe and loosened to release the head assembly from the vent pipe. A control, handle, lever or similar device takes input from the operator and affects the clamp to grab and hold onto the vent stack. The clamp has a control that is positioned to be accessible by an operator standing on a ground that effectively tightens or loosens the clamp when both the tip is engaged into the vent pipe and the clamp is around the exterior top of the vent pipe. Depending on the application the clamp might be in the bottom six feet or so of the pole assembly, but this is not a precise measurement as long as it can be operated while the boom is in use and from the ground. The pole assembly and head assembly when combined have a continuous interior volume from the an aperture near the first end of the pole assembly through the head assembly. This is a chase for a reamer, camera, etc. . . . . The interior volume is dimensioned to accept a long plumbing apparatus. The long plumbing apparatus is selected from any of a plumber's snake, a pressure washer cleanout, a camera, or pipe repair tool.

The device can also include optionally a head assembly that includes an articulating hinge to vary the angle between the pole assembly and the head assembly. The angle between the head and axis of the tip segment of the head assembly is often between about 45 and 90 degrees, but this is not required to be in this range and remain within the spirit of the invention. The bend should be enough so that the tip can easily insert into the vent stack and the snake can still easily pass through the pole assembly and head assembly out the tip and into the vent. The head assembly could also include a flexible segment, like a rubber pipe section, that flexes to vary the angle between the pole assembly and the head assembly. The pole assembly can be comprised of a plurality of telescoping pipe segments or of a plurality of pipe segments each connected end to an adjacent pipe segment with a union. Optionally the pole assembly can have a base or legs at the first end, or the lower half of the pole assembly that prevents the pole assembly from rolling axially during use when the snake is torqued and forced through the device.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cleanout boom comprised of a pole assembly and a head assembly;

the pole assembly has a first end and a second end;

the head assembly has a clamp between a first end and a tip;

the second end of the pole assembly is affixed to the first end of the head assembly;

the tip is dimensioned to engage into a predetermined roof vent pipe and guide the head assembly over the roof vent pipe;

when the tip is engaged into the roof vent pipe to a predetermined dimension then the clamp is positioned around an exterior top of the roof vent pipe;

the clamp can be operatively tightened to affix the tip inside the roof vent pipe and loosened to release the head assembly from the roof vent pipe;

the clamp has a remote control that is positioned at the first end of the pole assembly that tightens or loosens the clamp onto the roof vent pipe when both the tip is engaged into the roof vent pipe and the clamp is around the exterior top of the roof vent pipe;

the pole assembly and head assembly when combined have a continuous interior volume from an aperture near the first end of the pole assembly through the head assembly;

the interior volume is dimensioned to accept a long plumbing apparatus continuously from the aperture, through the head assembly and into the roof vent pipe so that the plumbing apparatus can be fed through the interior volume and guided into the roof vent pipe;

the long plumbing apparatus is selected from any of a plumber's snake, a pressure washer cleanout, a camera, or pipe repair tool.

2. A cleanout boom as disclosed in claim 1 further characterized in that the head assembly includes an articulating hinge to vary the angle between the pole assembly and the head assembly.

3. A cleanout boom as disclosed in claim 1 further characterized in that the head assembly includes a flexible segment that flexes to vary the angle between the pole assembly and the head assembly.

4. A cleanout boom as disclosed in claim 1 further characterized in that the pole assembly is comprised of a plurality of telescoping pipe segments.

5. A cleanout boom as disclosed in claim 1 further characterized in that the pole assembly is comprised of a plurality of pipe segments each end connected to an adjacent pipe segment with a union.

6. A cleanout boom as disclosed in claim 1 further characterized in that the pole assembly has a base at the first end that prevents the pole assembly from rolling axially during use.

7. A cleanout boom comprised of a pole assembly and a head assembly;

the pole assembly has a first end and a second end;

the head assembly has a clamp between a first end and a tip;

the second end of the pole assembly is affixed to the first end of the head assembly;

the tip is dimensioned to engage into a predetermined roof vent pipe and guide the head assembly over the roof vent pipe;

when the tip is engaged into the roof vent pipe to a predetermined dimension then the clamp is positioned around an exterior top of the roof vent pipe;

the clamp can be operatively tightened to affix the tip inside the vent pipe and loosened to release the head assembly from the roof vent pipe;

the clamp has a remote control that is positioned at the first end of the pole assembly that tightens or loosens the clamp onto the roof vent pipe when both the tip is engaged into the roof vent pipe and the clamp is around the exterior top of the roof vent pipe;

the pole assembly and head assembly when combined have a continuous interior volume from an aperture near the first end of the pole assembly through the head assembly;

the interior volume is dimensioned to accept a long plumbing apparatus continuously from the aperture, through the head assembly and into the roof vent pipe so that the plumbing apparatus can be fed through the interior volume and guided into the roof vent pipe;

the long plumbing apparatus is selected from any of a plumber's snake, a pressure washer cleanout, a camera, or pipe repair tool;

the head assembly includes an articulating hinge to vary the angle between the pole assembly and the head assembly;

the pole assembly is comprised of a plurality of pipe segments each connected end to an adjacent pipe segment with a union;

the pole assembly has a base at the first end that prevents the pole assembly from rolling axially during use.

* * * * *